United States Patent [19]

Fecker et al.

[11] 4,136,837

[45] Jan. 30, 1979

[54] POSITIVE TAPE FEED WITH MULTIPLE YARN WINDINGS

[75] Inventors: Josef Fecker, Bisingen-Steinhofen; Gustav Memminger, Freudenstadt, both of Fed. Rep. of Germany

[73] Assignee: Gustav Memminger Verfahrenstechnik für die Maschenindustrie, Freudenstadt, Fed. Rep. of Germany

[21] Appl. No.: 827,869

[22] Filed: Aug. 26, 1977

[30] Foreign Application Priority Data

Aug. 31, 1976 [DE] Fed. Rep. of Germany ..... 2639207

[51] Int. Cl.[2] ..... B65H 51/02; D04B 15/48; D04B 35/14

[52] U.S. Cl. ..... 242/47.01; 66/132 T; 242/47.12

[58] Field of Search ..... 66/132 T, 132 R; 242/47.12, 47.01

[56] References Cited

U.S. PATENT DOCUMENTS

| | | | |
|---|---|---|---|
| 3,590,601 | 7/1971 | Sugiura | 66/132 T |
| 3,709,444 | 1/1973 | Tannert | 66/132 T |
| 3,785,176 | 1/1974 | Hebbecken et al. | 66/132 T |
| 3,802,228 | 4/1974 | Deniega | 66/132 T |
| 3,922,887 | 12/1975 | Mishcon | 66/132 T |

FOREIGN PATENT DOCUMENTS

| | | | |
|---|---|---|---|
| 1269284 | 5/1968 | Fed. Rep. of Germany | 66/132 T |
| 2283971 | 9/1974 | France | 66/132 T |

OTHER PUBLICATIONS

Advertisement in Knitting International, 83 (990): p.—Jun. 1976.

Combined Tape/Capstan Yarn Feed in Knitting International 83(990): p. 98, Jun. 1976.

*Primary Examiner*—Werner H. Schroeder
*Assistant Examiner*—Andrew M. Falik
*Attorney, Agent, or Firm*—Flynn & Frishauf

[57] ABSTRACT

A freely rotatable yarn feeding drum has a plurality of yarn loops wound thereon to form a storage winding. To both drive the drum and axially sheave the yarn forming the storage windings along the length of the drum, a drive wheel, or drive belt is engaged with the circumference of the drum in the region of the storage windings. The drive means thereby directly engages the yarn and the drum and, preferably, the axis of rotation of the drum is so set that it forms an acute angle with the axis of rotation of the drive means to provide an axial frictional component between the drive means, typically a drive belt, and the windings on the drum so that the windings are fed axially.

13 Claims, 4 Drawing Figures

POSITIVE TAPE FEED WITH MULTIPLE YARN WINDINGS

Cross reference to related applications and assigned to the assignee of the present invention: U.S. Ser. No. 821,870, filed Aug. 26, 1977, to Kuhn et al.

The present invention relates a yarn feeding apparatus for textile machinery, and more particularly to feed yarn under slip-free conditions to a utilization position of a textile machine, for example to a knitting feed of a circular knitting machine.

BACKGROUND AND PRIOR ART

Rotary yarn feeding apparatus in which yarn is wound on a drum have previously been proposed. Usually, a plurality of windings, or loops of the yarn are wound on the drum to form a storage winding. Such drums are driven either individually, or, as is cutomary, may be driven by means of an endless drive belt which, in turn, is driven from the central drive of the machine. The drive belt engages a pulley which is coupled to the storage drum. If the arrangement is to be used with circular knitting machines, then the drive belt is usually common to all the feeds of the machine, the drive belt itself being driven from a central position either separately or from the main drive of the machine, directly, or through an intermediate speed change arrangement. In some constructions, the pulley driving the drum and the drum itself are combined to form one constructional unit in order to save space and decrease the overall size of the yarn feeding apparatus--see, for example, German disclosure document DT-OS Nos. 2 159 154 June 14, 1973.

To provide slip-less feed of the yarn from the drive, it is necessary to place a comparatively large number of loops on the drum so that there is little slip between the yarn and the drum due to the extended frictional engagement formed by the number of loops. As the number of loops or windings on the drum increases, the feed in axial direction of the loops to permit feeding of the yarn from the storage position becomes increasingly complex. Various feed arrangements have been proposed, for example wobble disks or the like which continuously feed the storage windings axially along the drum so that the windings placed on the storage zone will wind evenly and can be removed continuously and with uniform tension.

THE PRESENT INVENTION

It is an object to simplify the yarn feeding arrangement in which yarn is fed under slip-less conditions to a utilization position of a textile machine, and more particularly to simplify the structure so that it can be universally used.

Briefly, the yarn drive means, which may be a rotatable disk or, preferably, an endless belt is positioned relative to the drum to engage the drum in the region of the storage windings, at least a portion of the plurality of windings of the storage drum being located at the zone of engagement between the drive means and the drum to provide for direct frictional engagement of the yarn on the drum and of said drive means.

The apparatus thus provides for direct transmission of torque from the drive means, typically an endless belt, to the drum over the storage windings on the drum themselves. Thus, the drive means simultaneously presses a circumferential portion of the storage windings of the yarn against the circumference of the storage drum. The yarn is thus fed without slip from the drum, even if the number of loops of the yarn around the storage drum is low, or if the tension of the yarn, or thread on the storage drum is low, for example to accomodate yarn or thread of poor quality. To provide for axial feed of the storage loops on the drum, the axis of rotation of the storage drum includes an acute angle with a line perpendicular to the plane of movement of the drive means. This acute angle results in an axially directed force being applied to the drum, and hence to the yarn with which the drive means is engaged so that the storage windings on the yarn will be automatically fed axially on the storage drum. In that region in which the drive belt or disk overlaps the storage winding, the axially acting component of force will move the windings axially along the drum. If the angle of inclination of the axis of rotation of the drum is adjustable, it is possible to adjust the rate of feed of the yarn. This is particularly advantageous if the apparatus is to be used with multi-feed circular knitting machines so that the axial feed of the yarn at each feed of the machine can be matched to the requirement of the knitting machine at the specific feed.

Drawings, illustrating an example:

Figure 1:
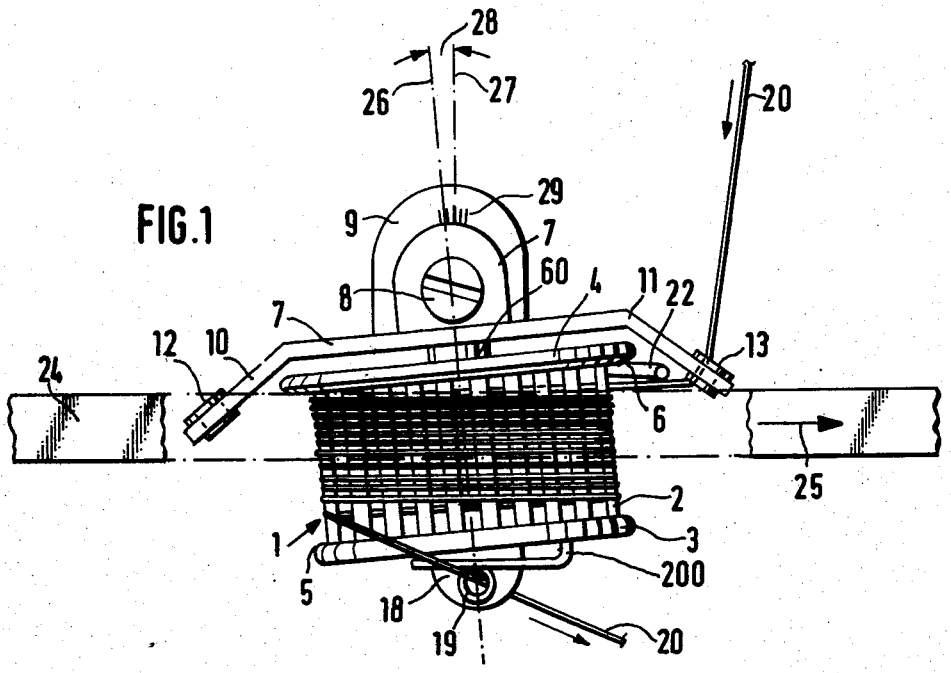
FIG. 1 is a front view of the yarn feeding apparatus in which elements not necessary for an understanding of the invention have been omitted.

The apparatus as illustrated in the the drawings is particularly adapted for use with circular knitting machines. A cylindrical drum 1 is formed as a cage, and consists of two end disks 3, 4, connected by pins or rods 2, which are spaced from each other, forming a squirrel-cage type structure. The ends disks 3, 4, have edges 5, 6, which project beyond the circumference of the cylinder formed upon rotation of the pins 2. The drum 1 is rotatable on a shaft 60 and secured thereto by suitable bearings (not shown). The shaft 60, which is non-rotatable, is secured to a holder 7, which is formed as an angled element, attached by means of a screw or bolt 8 to the front surface of a holder bracket 9. The angled holder 8 can be angularly adjusted by loosening the screw 8, and retightening it after adjustment of the holder 7 with respect to the bracket 9. The angled element 8 is formed with two laterally projecting arms 10, 11, each of which has a yarn guiding eye 12, 13, respectively, secured thereto or formed therein.

Figure 3:
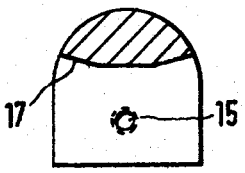
FIG. 3 is a fragmentary cross sectional view along line III—III of FIG. 2 illustrating an arrangement allowing for fixed angular positions of the drum holder.

The bracket 9 is formed as a projecting arm with a terminal end portion which leaves an opening 14, permitting placement of the bracket 9 on a carrier ring to secure the bracket 9 to a circular knitting machine, for example. The bracket 9 can then be clamped to the carrier rings by a bolt passed through the tapped hole 15. Two contact pins 16 are placed in the opening 14 to provide electrical contact with a circular contact strip formed on the carrier ring which, in turn, is connected to the electrical network forming the stop-motion control system for the knitting machine. The upper inner surface 17 of the bracket facing the opening 14 is not square but, rather, formed with a square center portion and two tapered side portions, as best seen in FIG. 3 to permit placing the bracket 9 on the carrier ring either in a centered position or angled with respect thereto in two predetermined angles by keeping the bracket 9 to engage the one, or the other of the tapered end portions of surface 17 and then clamping the bracket 9 by suitable bolt passed through hole 15.

A depending arm 18 is located on the bracket 9 and secured thereto in the vicinity of the opening 14. Bracket 9 has a yarn removal eye 19 formed therein. A yarn sensor 200 is secured to a stop-motion contact box 21 and located to sense yarn being removed from storage drum 1 through the yarn removal eye or guide 19. A yarn sensor 22 is also secured to and electrically connected to the stop-motion box 21 to sense yarn 20 being supplied through the yarn supply eye 13 to the drum 1. The box 21 is internally electrically connected to the terminal 16 as well known. If either one of the yarn sensors 22 or 200 responds, an electrical circuit is provided which causes, or controls disconnection of the textile machine, typically a knitting machine to which yarn is being supplied and/or provides a warning signal to a machine operator.

Figure 2:
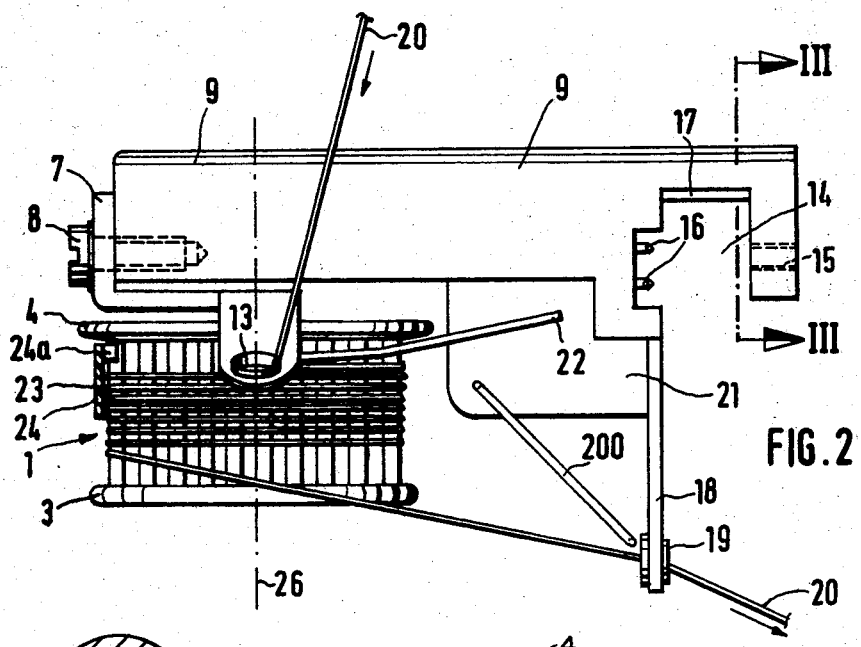
FIG. 2 is a side view of the apparatus of FIG. 1, illustrating drive by means of a belt.

The yarn 20 is supplied from a supply pirn, or yarn package (not shown) and guided through the supply eye 13, to be then wound in a number of storage loops on drum 1, to form a plurality of storage windings thereon. The tension of the supply portion of the yarn is sensed by sensor 22; if the tension falls off, or if the yarn should break, the sensor 22 can snap downwardly (FIG. 2) and thus trigger the switch in stop-motion sensing box 21. As best seen in FIG. 2, the yarn supply eye 13 is preferably positioned to be somewhat below the upper edge of the upper end disk 4. The yarn 20, after having passed through the eye 13 is then looped about the drum to form a plurality of storage windings collectively at 23, to be then pulled off the drum 1 through the yarn removal eye 19. It can then be used or worked on at a suitable utilization position of the textile machine, for example being supplied to the knitting feed of a circular knitting machine. The yarn being removed is checked by the sensor 200 which, upon drop off of yarn tension or breakage of yarn, operates the stop-motion system included in the stop-motion box 21 and connected to terminal 16.

The storage drum 1 is rotated by a drive system which, in the embodiment shown in FIGS. 1 and 2, is a flat drive belt 24 which loops around drum 1 at least in part, or engages the drum 1 tangentially. In FIG. 1, the belt is shown transparent so that the windings below are also visible. It moves in the direction of the arrow 25. The drive belt 24 can drive the various supply drums associated with the various feeds of a knitting machine if the utilization apparatus is a circular knitting machine having a common drive belt for all, or a plurality of yarn supply drums. The belt 24 is driven by a suitable drive motor, or directly from the knitting machine. The belt 24 engages drum 1 in the region of the position of the storage windings 23 in such a manner, that the drive belt 24 partially overlaps, or covers the storage windings 23. The belt 24, at the position of engagement between the belt and the circumference of the drum 1 thus is in frictional engagement with the yarn 20 in the region where the yarn 20 forms the storage windings. The drive belt 24 can be formed as an at least partially toothed, or gearshaped belt. For example, a tooth 24a (FIG. 2) located at the upper edge of belt 24 is positioned to engage between the gaps of the various pins 2 forming the drum 1 to provide positive slip-free engagement between the belt 24 and the drum 1.

The inclination of the axis of rotation 26 of the drum 1 can be changed not only by rocking the bracket 9 about the surface 17, but additionally, or instead of the rocking arrangement, to adjust the angle by adjustment of the holder 7. Thus, the angle 28 between the axis of rotation 26 of drum 1 and an imaginary line 27 perpendicular to the direction of movement of the belt 27 is adjustable. The extent of inclination can be read on a scale 29 (FIG. 1) formed on the face of the bracket 9 and cooperating with a marker formed on the angled holder 7.

The yarn 20, supplied to the drum 1 first is looped about the drum in the plane, or at the level defined by the position of the eye 13. It is then passed between the outer circumference of the pins 2 forming a drum 1 and the belt 24. Since the belt 24 and the drum 1 are inclined by angle 28 with respect to each other, and the friction between the belt 24 and the yarn is greater than the friction between the pins 2 of the drum 1 and the yarn, the yarn will follow the drive belt 24 which, due to the relative inclination with respect to the axis of rotation 26 of the drum, provides an axial force component to the yarn, that is, to the plurality of loops forming the storage winding 23. Thus, the storage windings 23 will be axially moved downwardly (FIG. 1) in dependence on the angle of inclination 28 and on the circumferential engagement portion of the drive belt 24 with respect to the storage drum 1, so that the loops forming the storage winding 23 are axially moved towards the lower end disk 3 of drum 1. The yarn is then removed at a position which is axially below that of the incoming eye 13. Before being removed, the yarn can loop about the drum 1 in a plane similar to that of the first winding around the drum 1 but axially offset with respect thereto. As the belt 24 moves the yarn downwardly, it is continuously removed from the drum through eye 19. Any discrete point on the yarn is thus first fed to the drum, then moved axially downwardly as it is looped around the drum and follows the windings of the storage loop, and then eventually removed. This process continues for all windings until the windings have left the overlapping, or covering range between the belt 24 and the drum 1.

The spacing of the various windings of the loops with respect to each other can be changed, or adjusted by changing the angle of inclination 28 and/or the extent of circumferential engagement of the belt 24 with respect to the drum 1. If the angle of inclination 28 is increased, and/or the circular overlap, or engagement between the belt 24 and the drum is increased, the spacing between windings is likewise increased.

The drum 1 can be used, as desired, to operate in either direction. As shown, it is positioned to operate in right hand direction. To operate in reverse direction, the yarn 20 is threaded through the yarn inlet eye 12.

The drum 1 can be placed to be exactly perpendicularly with respect to the direction of rotation of the belt 24, that is, in a position in which the angle 28 is 0°. In this position, no axial feed component of force is applied to the storage windings 23. It is still possible to operate in this position, however, and using only a few loops to form the storage windings 23, since the yarn inlet eye 13 and the yarn removal eye 19 are vertically offset, that is, are staggered in their position with respect to the axis 26 of the drum 1. As a result, the yarn fed through the eye 13 (or 12 respectively) will be wound spirally around the drum 1.

Figure 2A:
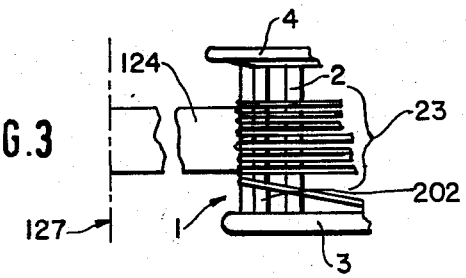
FIG. 2a is a fragmentary highly schematic view illusting drive by means of a drive drum or drive disk.

The drive belt 24 can have an externally and/or internally smooth surface and be made of the usual belting materials. It may also have a toothed shape, to provide projecting teeth 24a which engage between the pins 2 of the drum 1 in the region beyond the storage winding 23. The belt can also be made in such a manner that its teeth extend over the region of the storage windings 23 and slightly press the loops of the yarn under storage winding 23 in the gaps between the pins 2. The belt 24 need not be a solid belt but may be perforated, or formed with openings therein. FIG. 2a shows another embodiment in which the drum 1 is shown only in fragmentary form, engaged by a gear wheel 124 which has projecting teeth engaging between the gaps 202 between adjacent pins 2 of the drum 1. The gear wheel 124 rotates about an axis of rotation 127 which may be inclined with respect to the axis of rotation 26 of the drum 1, or parallel thereto, as explained in connection with belt 24. The wheel 24 need not be a gear, but can be smooth, that is, provide a smooth outer circumference similar to the engaging surface of a smooth belt 24, which transfers drive torque in the region of the storage windings 23, so that the storage windings 23 will be positioned between the engagement zone or region of the drum 1 and the circumference of the drive wheel 124, that is, so that the storage windings 23 will be at least partially engaged by the wheel 124.

The arrangement as illustrated in FIGS. 1 and 2 provides for individual angular adjustment of the angle of inclination 28 of the axis of rotation of the drum with respect to its drive element by loosening screw 8 and rotating the entire drum 1. In a more simple form, the screw 8 and the end adjustment can be omitted, and the drum 1 secured in perpendicular alignment with respect to the bracket 9. If it is desired to tilt the drum 1 with respect to the drive means, the entire bracket 9 is then tipped. The chamfered surface 17 permits setting of the drums either in perpendicular direction, or in the one or other direction of inclination, as desired, by a fixed angle and thus permits rapid adjustment of the drum with respect to its drive means. Using straight surfaces which are relieved with respect to a center flat surface provides for simple fixed angular adjustment which can easily be carried out even by unskilled personnel. If the surfaces are rounded, that is, are of essentially circular form, more skill is required although the angle of adjustability can be varied as desired. Two surfaces which are chamfered are provided in order to permit the supply drum 1 to be used for either direction of rotation. As shown, the axis of rotation of the drum 1 can be located in either one of three positions: an inclined position for clockwise rotation in which the axis of rotation 26 of the drum 1 is to the left of the perpendicular line 27, a neutral central position in which the movement of the drum is about an axis perpendicular to the direction of movement of its drive means, and an inclined position for counter-clockwise rotation in which the axis of rotation 26 of the drum 1 is to the right of line 27.

The spacing between pins 2 of the drum 1 and the distances between teeth 24*a* of the belt 24—if used—should be so selected that reliable engagement of the respective teeth of the belt, or of a disk, between the gaps of the pins is insured even if the drum one has its axis of rotation inclined with respect to the engaging drive belt or disk. The teeth 24*a*, therefore, should be narrower than the gaps between pins 2.

The drawings are highly schematic; the windings on the storage winding 23 in FIGS. 1, 2, and 2a are only shown schematically. In actual fact, the planes of looping in the region of engagement of the drive means 24 are inclined with respect to the drum 1 by approximately the angle 28, that is, the angle between the axis of rotation of the drum 1 and the direction of movement of the drive means. Outside of the actual zone of engagement between the storage windings 23 and the belt 24, or drive disk 124, the windings are essentially parallel to the end disks 4, 5.

The angle 28 has to be matched to the yarn thickness, quality of the yarn, surface characteristics of the yarn, of the belt, and various other parameters.

For a 401, polyester/wool yarn fed to circular knitting machine, with a pull-off speed of ca. 150 m/min from a drum of ca. 50 mm diameter, and a drum rotational speed of ca. 950 RPM, an angle of 5° is suitable. For circular knitting machines, the usual angle 28 is in the range of about degrees to 2° - 20° degrees.

An arrangement in which the bracket 9 has a flat surface 17, that is, not chamfered as shown in FIG. 3, has the advantage of simplicity of manufacture and initial attachment to a holding ring of a textile machine, for example circular knitting machine, but requiring more skill in individual adjustment of the angle 28. Providing the surface 17 as shown in FIG. 3, separately or additionally to adjustment by screw 8 and tilting the axis of rotation of drum 1 facilitates later adjustment at the cost of slightly greater requirements being placed on the accuracy of shaping the surface portions of surface 17. If the axis of rotation of the drum 1 is perpendicular to the direction of drive, for example of belt 24, a few loops suffice to form the storage windings 23. In spite of the perpendicular arrangement, the storage winding will be spiraled about the drum due to the axial relative offset of the incoming eye 12, 13 and a take-off eye 19 through which the yarn 20 must pass.

In use with a circular machine, the drive belt 24 preferably is common to a plurality of knitting feeds and partially loops about a portion of the outer circumference of the drums 1 associated with the respective knitting feeds. This belt, common to the drums 1 of the machine, can be driven directly from the machine or separately. If the belt is formed with internal teeth, any slip between the drum and the belt is effectively prevented. If the teeth extend into the region of the storage windings, the yarn is pressed in the space between the pins of the drum so that slip between the yarn and the drum is effectively prevented even though the number of windings about the drum is small.

The invention has been explained in connection with a drum having the shape of a squirrel cage--using a terminology customary for constructions of this type in the electrical induction motor field—although different arrangements may be used. For example, the circumference of the drum 1 may be solid and formed with corrugations; thus, the term "cage-type drum" is meant to include any drum in which the outer surface is formed with uniformly distributed depressions—as gaps between pins, or internally extending corrugations—in which the teeth of a ribbed, or at least partially ribbed belt, or disk or wheel could engage.

Various changes and modifications may be made within the scope of the inventive concept.

We claim:

1. Yarn feeding apparatus to feed yarn (20) under slip-free conditions to a utilization position of a textile machine comprising a rotatable storage drum (1) forming an essentially cylindrical storage drum (1);

a drive means (24, 124) rotatably driving the storage drum;

supply yarn guide means (12, 13) to guide yarn for supply to said drum;

removal yarn guide means (18, 19) to guide yarn for removal from the drum, the yarn forming a plurality of storage windings (23) on the drum before removal therefrom at a rate corresponding to the rotational speed of the drum, wherein the drive means (24, 124) are positioned relative to the drum (1) to engage the drum at the outer circumference thereof, in the region of a portion of the axial length of the drum, at least a portion of the plurality of windings of the yarn on the storage drum being located in the zone of engagement between the drive means (24, 124) and said drum (1) to provide for direct frictional engagement of at least a portion of the yarn on the drum and said drive means, and wherein the axis of rotation (26) of the drum (21) forms an acute angle (28) with a line (27) perpendicular to the direction of movement of said drive means (24, 124) to apply an axially directed force to the yarn on the drum beneath the drive means to feed all the storage windings of the yarn on the drum axially along the storage drum.

2. Apparatus according to claim 1, wherein said angle is in the range of about from 2° – 20° degrees.

3. Apparatus according to claim 1, wherein means (7, 8, 9, 14, 15, 17) are provided adjustably attaching the drum (1) to the textile machine.

4. Apparatus according to claim 4, wherein said attaching means comprises a bracket (9) to adjustably attach the drum to the textile machine.

5. Apparatus according to claim 4, wherein said attachment means comprises a bracket (9) formed with means (17) attaching the drum to a textile machine at selected angles of inclination.

6. Apparatus according to claim 1, wherein the supply yarn guide means (12, 13) and the removal yarn guide means (18, 19) include yarn guide eyes, the supply yarn guide eyes (12, 13) and the removal yarn guide eyes (19) being axially offset with respect to the axial lengths of the drum by a distance corresponding approximately to the width of the storage windings (23) formed on the drum in operation of the apparatus.

7. Apparatus according to claim 1, wherein (FIGS. 1, 2) said drive means comprises a drive belt (24) partially circumferentially engaging said storage drum (1).

8. Apparatus according to claim 8, wherein the drive belt (24) has a flat surface at the side at which the belt engages the drum.

9. Apparatus according to claim 8, wherein the belt (24) is a toothed, or ribbed belt, the drum is formed with a corrugated outer surface, the teeth (24*a*) or ribs of the belt engaging in the gaps between the outer portions of the corrugations of the drum.

10. Apparatus according to claim 1, wherein (FIG. 2*a*) the drive means comprises a disk, or wheel or drive drum having an outer surface engaging the storage drum (1) in the region of the storage windings (23).

11. Apparatus according to claim 16, wherein the outer surface of the disk, wheel, or drive drum (124) is essentially smooth.

12. Apparatus according to claim 10, wherein the drive disk, wheel, or drum (124) has an outer corrugated, or toothed or gear-like surface, the drum has a corrugated outer surface, the ribs, projections, or teeth of the disk, wheel, or drive drum engaging in the depressions or gaps between the corrugations of the storage drums (1).

13. Apparatus according to claim 1, further comprising a holding bracket (7, 9) adapted for attachment, said drum (1) being rotatably secured to said bracket, said bracket being adapted for attachment to the textile machine;

and an engagement surface (17) formed on said bracket and positioned for cooperation with a surface on the machine to selectively position the bracket, and hence the drum, for selective placement of the axis of rotation of the drum at an acute angle to the right, or to the left with respect to a line perpendicular to said directional movement.

* * * * *

UNITED STATES PATENT AND TRADEMARK OFFICE

CERTIFICATE OF CORRECTION

PATENT NO. : 4,136,837

DATED : January 30, 1979

INVENTOR(S) : Josef FECKER et al

It is certified that error appears in the above–identified patent and that said Letters Patent are hereby corrected as shown below:

Claim 4, column 7, line 37, change "according to claim 4" to read -- according to claim 3 --

Claim 11, column 8, line 23, change "claim 16" to read -- claim 10 --

Signed and Sealed this

*Tenth* Day of *July 1979*

[SEAL]

*Attest:*

*Attesting Officer*

LUTRELLE F. PARKER

*Acting Commissioner of Patents and Trademarks*